United States Patent [19]

Calvert

[11] Patent Number: 4,944,437

[45] Date of Patent: Jul. 31, 1990

[54] SEWING THIMBLE

[75] Inventor: Nathaniel Calvert, Rochester, Minn.

[73] Assignee: IN Motion, Inc., Minneapolis, Minn.

[21] Appl. No.: 243,482

[22] Filed: Sep. 12, 1988

[51] Int. Cl.[5] ..... D05B 91/04; A41D 13/00

[52] U.S. Cl. ..... 223/101; 2/21

[58] Field of Search ..... 2/21; 223/101; 132/73

[56] References Cited

U.S. PATENT DOCUMENTS 2,461,872 2/1949 Beatty ..... 2/21

2,925,605 2/1960 Wheeler ..... 2/21

4,239,134 12/1980 Joy ..... 223/101

*Primary Examiner*—Werner H. Schroeder

*Assistant Examiner*—Bibhu Mohanty

*Attorney, Agent, or Firm*—Douglas L. Tschida

[57] ABSTRACT

A two-sided thimble including an elastic fitting member and a hand pull flap. A first envelope surface permits fine needle work and a second surface including a contained rigid protective member facilitates heavy duty needle work. In an alternative construction, each surface may accommodate either heavy or fine needlework.

9 Claims, 1 Drawing Sheet

SEWING THIMBLE

BACKGROUND

The present invention relates to sewing thimbles and, in particular, to a soft-walled thimble having two useful surfaces and configured for ready mounting/removal from a variety of finger sizes.

A long known safety device used by seamstresses against errant needles and/or finger injury when sewing is the sewing thimble. A variety of constructions of thimbles are commonly found in closed-ended, conical hard-shelled configurations which slip fit over the end-most phalanx of the wearer's finger, typically the index finger. Although such thimbles protect the wearer, due to their rigidity they are awkward to use for a number of sewing tasks. The rigid wall constructions also provide for a loose fit and require periodic re-fitting. A more pliable walled thimble is thus to be preferred which fits over a greater portion of the finger in conforming relation thereto.

Three conically constructed thimbles which generally fall into this latter category which are known to Applicant can be found upon directing attention to U.S. Pat. Nos. 4,127,222; 4,239,134 and 4,694,843. The 4,127,222 patent discloses a soft-sided molded construction, including vent holes and a fingernail receiving compartment. A thickened end protects the finger.

The 4,239,134 patent discloses a thimble having a soft shell wherein a slit is included in the upper fore end of the thimble which permits passage of the fingernail. An impenetrable member is mounted in the fingerprint area of the thimble for finger protection. The 4,694,843 patent compartmented, plastic construction which individually protects the fingernail and wearer's finger. All of the foregoing thimbles however mount only of the first phalanx of the finger.

The specialized compartmentalization of such thimbles and the single phalanx mounting requires the user to have available a number of different thimble constructions for various types of work. That is, for fine work a soft-walled thimble would typically be used, with a hard-walled unit being used for rougher duty needle work. Moreover, the protection provided does not extend beyond the single phalanx. A manufacturer must also maintain a variety of different diameter thimbles to accommodate different finger sizes, in contrast to a construction which adapts to a variety of finger sizes.

SUMMARY OF THE INVENTION

It is accordingly a primary object of the subject invention to provide for a thimble construction which covers a greater portion of the finger to be protected.

It is a further object of the invention to provide a construction having multiple useable surfaces, with each surface accommodating a different type of needle work application or alternatively the same application.

It is a further object of the invention to provide a construction which accommodates a range of different finger sizes and maintains a tight fit during its use.

It is a yet further object of the invention to include means facilitating the mounting and/or removal of the thimble.

Various of the foregoing objects and advantages are particularly achieved in a presently preferred construction which is constructed of a sewn, soft-sided leather shell or envelope which mounts over substantially all of the first two phalanges of a selected finger. An associated oblong pull flap or tongue facilitates mounting/removal. An internal elastic member divides the envelope bore and expands/contracts with finger insertion to provide for a firm fit of the shell to the selected finger.

The construction is also such that the thimble may be rotated about the finger to present a properly configured working surface to best fit the application. One surface of the thimble includes an internally constrained impenetrable member which is secured to the thimble in the finger print area. Relatively heavy duty needle work is accomplished with the impenetrable member facing down. Otherwise, upon rotating the thimble, an opposite soft side may be used to facilitate fine needle work. Alternatively, both working surfaces may be the same.

Various of the foregoing objects, advantages and distinctions, among others, as well as a detailed description of the presently preferred embodiment are described hereinafter with respect to the appended drawing. Before referring thereto, it is to be appreciated the following description is made by way of the presently preferred construction only which should not be interpreted literally in limitation of the invention. Rather, the invention should be interpreted to include all other constructions within the spirit and scope of the following appended claims. To the extent various modifications or improvements may have been considered, they are described as appropriate.

DESCRIPTION OF THE PREFERRED EMBODIMENT

Figure 1:
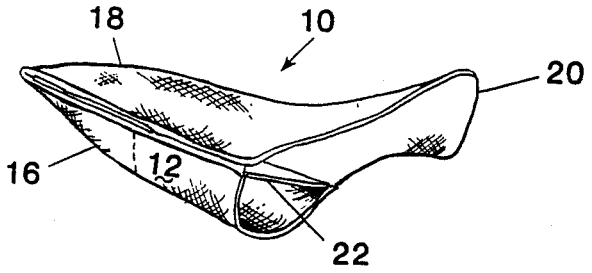
FIG. 1 shows an isometric view of the thimble of the present invention.
Figure 2:
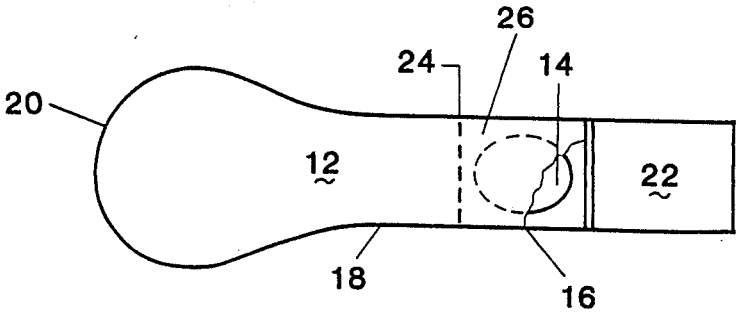
FIG. 2 shows an elevation view of the thimble of FIG. 1, when folded open.
Figure 3:
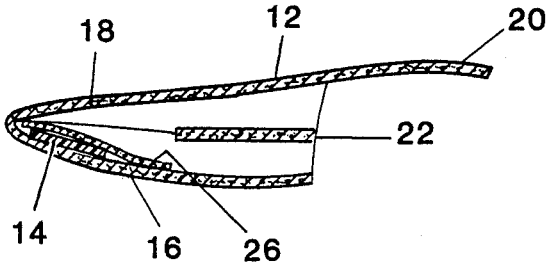
FIG. 3 shows a longitudinal cross section view through the thimble of FIG. 1.

Referring to FIG. 1, an isometric view is shown of the sewn thimble 10 of the subject invention. FIGS. 2 and 3, in turn, respectively show the thimble 10 of FIG. 1 when folded open along its right and left lateral seams and a longitudinal cross sectional view through the thimble.

Referring to FIG. 1, it is to be appreciated the thimble 10 is of an elongated construction approximately 3–5 inches long, and mounts over the first two phalanges of a finger in conforming relation to the finger tip. Mounted interiorly of the thimble in the lower surface of the shell or envelope 12 in the region of the finger tip is an impenetrable or rigid member 14 (reference FIGS. 2 and 3) which protects the fingertip while sewing.

Although the thimble 10 is shown when worn for heavy duty needle work with the multi-walled surface 16 facing down, alternatively, the thimble may be rotated to position the upper, single-walled surface 18 of the thimble 10 in covering relation to the fingertip. In the latter position, fine needle work may be effectuated. That is, the softsided, pliable nature of the thimble envelope 12 provides a greater flexibility and finger tip dexterity.

In its typical construction, the outer envelope 12 is constructed of a soft leather, although a variety of other supple, yet heavy duty materials might be employed.

For that matter, the outer cover on the upper surface 18 might be of a dissimilar material to that on the lower surface 16. For example, the fine work surface 18 might be a leather and the heavy duty surface might provide for a closely woven nylon or canvas material to cover the impenetrable member 14 or vice-versa. Moreover, while the embodiment shown contemplates different surfaces 16 and 18 constructions, they may be of the same construction. Thus, two impenetrable members 14 might be used or none at all.

In any case, the mounting of the thimble 10 is facilitated by way of a finger grab or pull-tongue 20 which extends from the extreme end of the fine sewing surface 18. During mounting, the wearer grasps the tongue 20 and pulls the thimble 10 tight onto the fingertip. This action firmly sets the thimble 10 about the fingertip and an interiorly included elastic strap member 22 which is sewn diametrically across the interior bore and which extends forward to a point slightly behind the member 14. Although a single pull-tongue 20 is provided, a pair of such tongues might be included on each surface such that one is always accessible on the upper finger surface which is the preferred position when mounting the thimble 10.

With attention directed to FIGS. 2 and 3, the tip mounted impenetrable member 14 and elastic strap 22 can better be seen in their normal mounting orientation. The impenetrable member 14 is particularly cut out of a piece of flexible Izing glass, plastic, metal, or other similar impenetrable material of an approximate thickness in the range of 1/64 to 1/16 inches. It exhibits an elongated, ovular shape and is positioned adjacent the fold line 24 of the pre-cut envelope material. An interior fabric cover 26 is sewn over the impenetrable member 14 to secure it to the inner wall and provide a liner adjacent the fingertip.

The strap of elastic 22 is sewn across the outer end of the surface 16 supporting the impenetrable member 14 and provides an interior adjustment loop when the fine surface portion 18 of the thimble 10 is folded over and sewn to the heavy duty surface 16. As seen in FIG. 3, the elastic strap 16 generally bisects the interior cavity such that the strap may mount above or below the wearer's finger. Preferably though the strap mounts beneath the finger. The strap also extends to the edge of the opening to the thimble 10 to facilitate mounting and also to prevent the thimble from pulling off the finger during use. Additional straps may be included if necessary to prevent removal.

One other variation Applicant has considered is the venting the envelope walls to minimize perspiration over protracted periods of usage. As mentioned, this may be accomplished by using an open weave material as part of the shell 12. In contrast, the prior art has typically provided random vent holes in a solid walled envelope.

While the present invention has been described with respect to its presently preferred embodiment and various modifications thereto, it is to be appreciated still other embodiments might suggest themselves to those skilled in the art. It is accordingly contemplated the following claims should be interpreted all those equivalent embodiments within the scope thereof.

What is claimed is:

1. A needle work thimble comprising:

(a) a pliable member folded upon itself and hemmed to form an elongated envelope surrounding an interior cavity;

(b) an elastic member secured interiorly of said cavity in the hem that forms said cavity;

(c) at least one rigid planar member secured interiorly of said cavity to one surface of said pliable member; and (d) wherein said cavity is sized to mount over at least the outer phalanx of a finger and is rotatable thereabout.

2. Apparatus as set forth in claim 1 wherein a fold line of said member is positioned to provide a flap portion extending beyond said cavity, whereby the envelope may be pulled onto a finger.

3. Apparatus as set forth in claim 1 wherein said planar member comprises an ovular-shaped impenetrable material relative to needles.

4. Apparatus as set forth in claim 1 wherein said pliable member comprises a leather.

5. Apparatus as set forth in claim 1 wherein said pliable member includes a portion constructed of a comparatively open weave material relative to the remainder of the pliable member.

6. Apparatus as set forth in claim 1 including a pliable cover secured to said pliable member and overlying said rigid planar member.

7. A needle work thimble comprising:

(a) a pliable member selected from a first material and including a vent region formed from a comparatively open weave material, folded upon itself and hemmed to form an elongated envelope surrounding an interior cavity;

(b) an elastic member secured interiorly of said cavity in the hem that forms said cavity;

(c) a rigid planar member secured interiorly of said cavity to one surface of said pliable member; and (d) wherein said cavity is sized to mount over at least the outer phalanx of a finger and is rotatable thereabout.

8. A needle work thimble comprising:

(a) a pliable member folded upon itself and hemmed along outer lateral edges to form an elongated envelope surrounding an interior cavity and wherein a fold line of said member is positioned to provide a flap portion extending beyond said cavity, whereby the envelope may be pulled onto a finger;

(b) an elastic member secured interiorly of said cavity in the hem that forms said cavity;

(c) at least one rigid planar member secured interiorly of said cavity to one surface of said pliable member and between an end positioned fold line and said elastic member;

(d) a pliable cover secured to said pliable member and overlying said rigid planar member; and (e) wherein said cavity is sized to mount over at least the outer phalanx of a finger and is rotatable thereabout.

9. A needle work thimble comprising:

(a) a pliable member folded upon itself and hemmed along outer lateral edges to form an elongated envelope surrounding an interior cavity and including a flap portion extending beyond said cavity, whereby the envelope may be pulled onto a finger;

(b) an elastic member secured interiorly of said cavity in the hem that forms said cavity; and (c) wherein said cavity is sized to mount over at least the outer phalanx of a finger and is rotatable thereabout.

* * * * *